United States Patent [19]

Strom-Olsen et al.

[11] Patent Number: 5,015,993

[45] Date of Patent: May 14, 1991

[54] FERROMAGNETIC ALLOYS WITH HIGH NICKEL CONTENT AND HIGH PERMEABILITY

[75] Inventors: John O. Strom-Olsen, Montreal; Piotr Z. Rudkowski, Pierrfond, both of Canada

[73] Assignee: Pitney Bowes Inc., Stamford, Conn.

[21] Appl. No.: 372,993

[22] Filed: Jun. 29, 1989

[51] Int. Cl.[5] ..... G08B 13/24

[52] U.S. Cl. ..... 340/551; 340/572

[58] Field of Search ..... 340/551, 572; 164/463

[56] References Cited

U.S. PATENT DOCUMENTS

| | | | |
|---|---|---|---|
| Re. 32,427 | 5/1987 | Gregor et al. | 340/572 |
| Re. 32,428 | 5/1987 | Gregor et al. | 340/572 |
| 4,527,614 | 7/1985 | Masumoto et al. | 164/463 |
| 4,568,921 | 2/1986 | Pokalsky | 340/572 |
| 4,642,145 | 2/1987 | Masumoto et al. | 148/336 |
| 4,710,754 | 12/1987 | Montean | 340/572 |

*Primary Examiner*—Glen R. Swann, III
*Assistant Examiner*—Thomas J. Mullen, Jr.
*Attorney, Agent, or Firm*—Peter Vrahotes; Melvin J. Scolnick; David E. Pitchenik

[57] ABSTRACT

Nickel rich amorphous ferromagnetic alloys having a nickel content in the range of 35 to 55 atomic percent have been conceived. These alloys are in the amorphous state and exhibit high permeability relative to prior known amorphous ferromagnetic alloys. These nickel rich alloys can be produced by rapid solidification techniques without the need of subsequent heat treating.

36 Claims, 1 Drawing Sheet

FERROMAGNETIC ALLOYS WITH HIGH NICKEL CONTENT AND HIGH PERMEABILITY

RELATED APPLICATIONS

Attention is directed to co-pending patent applications having similar subject matter entitled Electromagnetic Metal Fibers Having Use In Electronic Article Surveillance Markers And Method of Making Same, Ser. No. 290,547 and filed Dec. 27, 1988 and Cobalt-Niobium Amorphous Ferromagnetic Alloys filed concurrently herewith.

BACKGROUND OF THE INVENTION

Ferromagnetic alloys are well known and have had wide use throughout industry. One area where ferromagnetic alloys are receiving particular attention is in the field of electronic article surveillance (EAS) as disclosed by P. A. Picard in French patent no. 763,681 (1934). Generally, certain ferromagnetic alloys exhibit high magnetic permeability and low coercivity thereby making their use as an EAS marker attractive. In the past, it was suggested to use ferromagnetic strips or wires sandwiched between two attached layers of dielectric material to form markers that can be detected in a magnetic field as described in U.S. Pat. No. 4,581,524 and 4,568,921, respectively. U.S. Pat. No. 3,856,513 describes various amorphous alloys and methods for making the same. Although prior amorphous alloys have worked well, it would be advantageous to have amorphous materials that have properties that lend themselves to use in an EAS marker and are easy to fabricate and detect. One characteristic that is sought is near zero magnetostriction which is associated with high magnetic permeability. Although there are ferromagnetic alloys that demonstrate near zero magnetostriction, these alloys suffer an excessive dependence on the frequency of the applied field which means the range of frequency in which EAS markers can be detected is greatly reduced.

Another problem with prior amorphous ferromagnetic alloys of high magnetic permeability has been the need in their composition of a high quantity of cobalt, which is a strategic, expensive material, in their composition.

One advantageous form of ferromagnetic material is that of a fiber as disclosed in co-pending patent application no. 290,547. It had been found that ferromagnetic alloys in the form of fibers can be randomly oriented and still be detectable. What has been determined, however, is that the signal from such oriented fibers have a signal degradation relative to the amount of material.

SUMMARY OF THE INVENTION

Novel compositions of amorphous ferromagnetic alloys have been discovered having a high nickel content without the normally attendant loss of magnetic properties when subjected to bending and flexing. It has been found that the alloys of the instant invention, when in the form of a fiber, exhibit superior properties when compared to prior known ferromagnetic alloys. These amorphous ferromagnetic alloys contain between approximately 35 and 55 atomic weight percent nickel, and various percentages of cobalt, iron, silicon, boron or phosphorous, and either manganese, aluminum, chromium, vanadium or copper.

The nickel rich amorphous ferromagnetic alloys of the instant invention exhibit near zero magnetostriction, high magnetic permeability and low coercivity. In addition, these alloys have an unusually flat dependence of these properties on the frequency of the applied field whereby the usual frequency range is much enhanced over other near zero magnetostriction alloys, particularly in fiber form. Additionally, the nickel rich ferromagnetic materials are more easily fabricated because of their lower melting point. The amorphous ferromagnetic alloys of the instant invention have been found to nave excellent corrosion resistance, high ductility and high strength which lends these alloys to many uses. Surprisingly, the instant alloys have been found to be immune generally from the signal degradation of the prior alloys when in fibrous form and randomly oriented. Even more surprisingly, the instant alloys can be in vertical powder form and still be readily detectable.

DETAILED DESCRIPTION OF THE PREFERRED EMBODIMENT

Figure 1:
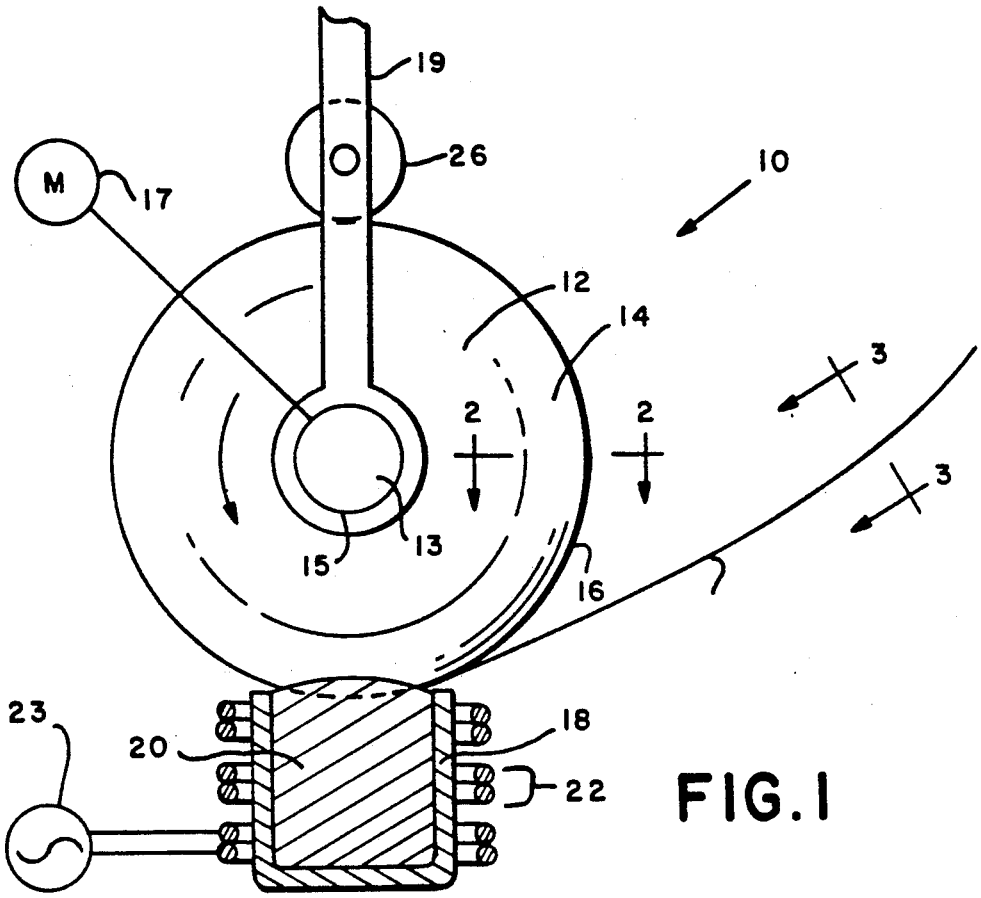
FIG. 1 is a longitudinal cross sectional view of a melt extraction device for producing ferromagnetic fibers.

It is known that the advantage of having near zero magnetostriction in a ferromagnetic alloy is that it leads to an alloy having high magnetic permeability and very low coercivity. These two properties are most useful when the ferromagnetic alloy is to be used as a marker in electronic article surveillance (EAS) uses. The alloys of the instant invention have a high nickel content and show high magnetic permeability and low coercivity, as do all ferromagnetic alloys with near zero magnetostriction. The alloys of the instant invention, however, have an unusual flat dependence of these properties on the frequency of the applied field. This means that the useful frequency range is much enhanced over other near zero magnetostrictive alloys especially when in fibrous form.

Although ferromagnetic alloys having a high nickel content are known, prior alloys, for the most part, have been alloys with a crystalline structure or amorphous alloys with relatively high magnetostrictive properties. The nickel rich ferromagnetic alloys of the instant invention are amorphous and have near zero magnetostrictive properties.

The nickel rich alloys of the instant invention have low a melting temperature than known amorphous ferromagnetic alloys that have a high cobalt and/or iron content. As a result of the lower melting temperature, the nickel rich alloys of the instant invention are easier to fabricate.

It has been found that the Curie temperature, i.e. the ferromagnetic ordering temperature, of the instant nickel rich amorphous ferromagnetic alloys can be chosen anywhere between −200° and +200° C. by increasing the metalloid (silicon and boron) content while retaining a high permeability in the ferromagnetic state. This implies a great potential for use as thermal switches and sensors. In contrast to prior crystalline nickel alloys with near zero magnetostriction, the nickel rich amorphous ferromagnetic alloys of the instant invention are ductile and are capable of retaining their magnetic properties after and during bending and flexing.

It has also been found that the instant nickel rich alloys are resistant to oxidation, and can therefore be cast in an ambient environment, although fabricating in an inert environment is preferred. This is in contrast to prior amorphous ferromagnetic alloys having high contents of iron and crystalline alloys having a high iron or nickel content which must be cast in a protective atmosphere or a vacuum. Furthermore, no heat treatment is required after fabrication of the alloys of the instant invention to obtain desirable magnetic properties.

An additional advantage of the alloys of this instant invention is that when using a plurality of fibers, short lengths are required for detection in a magnetic field as compared to prior known ferromagnetic alloys. It is not known why this particular class of alloys exhibits such property but it has been found empirically to be so. The length of a single fiber composed of a nickel rich amorphous ferromagnetic alloys fabricated in accordance with the instant invention and having a maximum transverse dimension of 80 microns and a length as short as 0.5 cm can be detected as is true for prior known alloys. Surprisingly, however, it has been found that fibers of the instant invention do not have their detectability diminished when a plurality of such fibers are oriented in a random manner.

Typical nickel rich, ferromagnetic amorphous alloy compositions of the instant invention are characterized by the formula:

TABLE I

| $N_aC_bF_cS_dB_eM_f$ |
|---|
| where N is nickel<br>C is cobalt<br>F is iron<br>S is silicon<br>B is at least one of boron or phosphorous<br>M is at least one of manganese, niobium, aluminum, chromium, vanadium, copper, and<br>"a-f" are in atom percent as follows:<br>"a" ranges from 35 to 55<br>"b" is equal to or less than 35<br>"c" ranges from 0 to 35<br>"d" is equal to or less than 30<br>"e" is equal to or less than 30<br>"f" ranges from 0 to 10 |

Examples of nickel rich amorphous ferromagnetic alloys are given by the following table:

TABLE II

| | Ni | Co | Fe | Si | B | Mn | Nb |
|---|---|---|---|---|---|---|---|
| 1 | 45 | 26 | 7 | 9 | 13 | — | — |
| 2 | 45 | 25 | 6 | 9 | 13 | 2 | — |
| 3 | 46 | 25 | 6 | 10 | 8 | 2 | 3 |
| 4 | 45 | 26 | 6 | 10 | 13 | — | — |
| 5 | 47 | 25 | 6 | 10 | 12 | — | — |
| 6 | 43.5 | 27 | 6.5 | 10 | 13 | — | — |
| 7 | 51.5 | 29 | — | 9 | 10.5 | — | — |

The best magnetic properties were found in ferromagnetic alloys having Ni in the range of 45 to 50 atom percent with a ratio $$\frac{B}{Si + B}$$

in the range of 0.55 to 0.65 and a ratio $$\frac{CO + Fe}{Si + B}$$

in the range of 1.25 to 1.80. With such ranges of the nickel rich alloys the magnetostriction is near zero.

The crystallization temperatures of nickel rich alloys as determined by differential scanning calorimetry are given in the following table:

TABLE III

| Ni | Co | Fe | Si | B | °K |
|---|---|---|---|---|---|
| 48 | 25 | 6 | 11 | 10 | 704 |
| 46 | 25 | 6 | 10 | 13 | 713 |
| 48 | 24 | 6 | 10 | 12 | 752 |
| 53.5 | 22 | 5.5 | 9 | 10 | 817 |
| 47 | 25 | 6 | 10 | 12 | 766 |

where °K = first crystallization peak at a scan rate of 80 deg/min.

The Curie temperature is strongly dependent upon the composition of the nickel rich alloy, especially upon the ratio Ni/Si+B+N, where N represents nonmagnetic elements.

The Curie temperature of selected nickel rich alloys of the instant invention are listed in the following table:

TABLE IV

| Ni | Co | Fe | Si | B | Cr | V | $T_c$ (°C.) |
|---|---|---|---|---|---|---|---|
| 47 | 22 | 5 | 13 | 13 | . | . | −123 |
| 45 | 25 | 6 | 11 | 13 | . | . | +9 |
| 45 | 26 | 6 | 9 | 14 | . | . | +57 |
| 46 | 28 | 6 | 9 | 11 | . | . | +240 |
| 45 | 25 | 6 | 9 | 13 | 2 | . | −110 |
| 45 | 25 | 6 | 9 | 13 | . | 2 | +9 |

The magnetic properties of toroidal samples of single fibers were measured on a number of samples and the following alloys yielded magnetization ($B_m$) and coercivity ($H_c$) in a driving magnetic field of peak to peak amplitude of 350 mOe and at a frequency of 6,000 $H_z$, as shown in Table V.

TABLE V

| Ni | Co | Fe | Si | B | Mn | $H_c$ (mOe) | $B_m$ (Tesla) |
|---|---|---|---|---|---|---|---|
| 45 | 26 | 6 | 10 | 13 | . | 91 | 0.14 |
| 43.5 | 27 | 6.5 | 10 | 13 | . | 109 | 0.23 |
| 45 | 25 | 6 | 9 | 13 | 2 | 63 | 0.27 |

As one skilled in the art will recognize, the above results show unusually high magnetic permeability.

the coercivity showed only a slow increase with applied frequency. The values $H_c$ for $Ni_{45}Co_{25}Fe_6Si_9B_{13}M_2$ measured on a toroidal type sample at room temperature in a magnetic field of peak-to-peak amplitude about 3 Oe are shown in the Table VI below. The alloy was in the form of a fiber having a cross section of $7.46\times10^{-6}cm^2$.

TABLE VI

| f | 1 | 2 | 3 | 5 | 6 | 10 | 15 | 20 | KHz |
|---|---|---|---|---|---|---|---|---|---|
| $H_c$ | 170 | 170 | 220 | 280 | 282 | 311 | 363 | 400 | mOe |

where f is the frequency of the magnetic field and $H_c$ is the coercivity.

Saturation magnetostriction values are dependent upon compositions, but well balanced near zero magnetostriction alloys are easily obtained. The table below shows two examples of alloys having near zero magnetostriction.

TABLE VII

| Ni | Co | Fe | Si | B |
|---|---|---|---|---|
| 42 | 28 | 7 | 10 | 13 |
| 45 | 26 | 6 | 10 | 13 |

The tensile strength of several samples of nickel rich alloys having compositions included in Table I was measured as cast alloy. The typical values ranged from 175 to 245 kg/mm$^2$.

It shall be noted, the percentages of metals in the above tables I–VII are all in atomic percent.

All alloy composition in the above tables were fabricated by the rapid solidification process (melt extraction) in the form of fine fibers i.e., a diameter of no greater than 80 microns. The amorphous, as well as partially amorphous samples of the alloys, were all ductile in the as quenched condition. The density of the alloys was found to be about 7.8 g/cm$^3$. The alloys of this invention are at least 50% amorphous and preferably at least 80% amorphous and most preferably 100% amorphous, as determined by X-ray diffraction.

Although described as having applicability in the field of electronic article surveillance in the form of fibers the nickel rich ferromagnetic amorphous metal of the invention can be in the form of ribbon, flakes, powder or wire. One advantage of these alloys is they do not have a tendency to corrode as is found often in alloy compositions having a high iron content. Other fields in which the nickel rich, amorphous ferromagnetic alloys of the instant invention can be used are: magnetic switches, magnetometers, magnetic field sensors, high frequency transformers, relays, generators, temperature sensors, electrical chokes and magnetic shielding.

Figure 2:
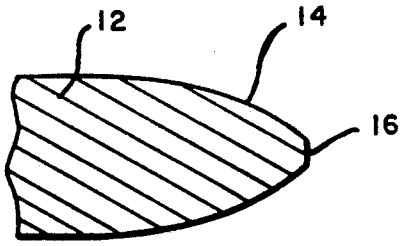
FIG. 2 is an enlarged, cross sectional view taken along the lines 2—2 of FIG. 1 of the perimeter of the spinning
Figure 3:
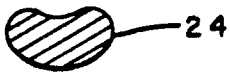
FIG. 3 is a cross sectional view taken along the lines 3—3 of FIG. 1 ,showing the cross section a fiber produced by FIG. 4 is a plan view of a composite web including fibers made by the device shown in FIG. 1.

Referring initially to FIGS. 1–3, a rotating-wheel device capable of producing rapid solidification is shown generally at 10 that produces ferromagnetic fibers in accordance with the principles of the instant invention. What is shown and will be described is a melt extraction technique but it will be appreciated that other techniques can be used in practicing the invention including melt spinning, melt drag and pendant drop method. Additionally, the fibers and ribbon of the instant invention can be molded in plastics, rubber, and resins and can be cast in flow temperature metal molds or into low melting temperature non-magnetic metals such as aluminum or zinc.

The spinning device 10 includes a disk 12, or wheel, which is fixedly supported by a rotatable shaft 13 which is received within a movable arm 19, and the disk has a reduced section 14 at its perimeter. The reduced section 14 has an edge 16 which can vary in thickness depending upon the size of fiber to be made. The disk 12 used in the reduction to practice of the invention had a diameter of six inches and the edge 16 had a radius of curvature of approximately 30 microns for the production of fibers, but 5 to 50 microns would be acceptable. The shaft 13 is in engagement with a motor 17 by any convenient connection so that the shaft, and the disk 12 that is mounted thereon, can be rotated.

A cup shaped tundish 18 is disposed below the disk 12 and is adapted to receive a ferromagnetic alloy composition 20. Induction coils 22 are disposed about the tundish 18 and are connected to a source of power 23. Upon sufficient power being applied to the coils 22, the ferromagnetic alloy composition 20 within the tundish 18 will become molten. The disk 12 is rotated as indicated by the arrow in FIG. 1 and upon the disk rotating within the molten alloy composition, it will produce a fiber 24 or ribbon 25. Optionally, in contact with the flange 14 is a wiper 26 made of a material such as cloth for the purpose of keeping the reduced section 14 clean.

Where ribbon is to be produced, the melt spinning technique is preferred in which 0.5 millimeter jet of liquid metal is directed onto a rapidly rotating flat copper wheel whose tangential velocity exceeds approximately 20 meters/sec.

Figure 4:
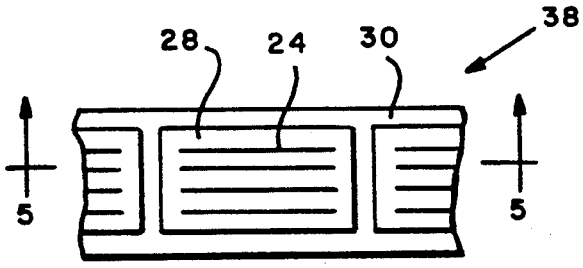
Figure 5:
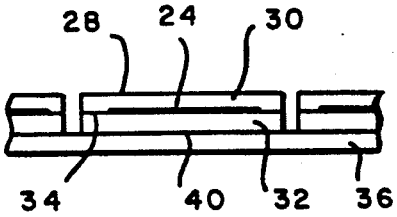
FIG. 5 is a cross sectional view taken along the lines 5—5 of FIG. 4 showing a side elevational view of the composite web.

Referring now to FIGS. 4 and 5, the fibers 24 are located between upper and lower sheets 30, 32 respectfully, that are joined by an adhesive 34 to form a detectable marker which is shown in the form of a label 28. Although a plurality of fibers 24 is shown, it will be appreciated only one fiber of appropriate length is necessary. The labels 28 are supported by a carrier web 36, to form a composite web 38 and the labels can be applied to the surface of an article through use of a labeller as is known in the art. As used in this disclosure, the term label is intended to include tickets and tags as well. Reference can be had to U.S. Pat. No. 4,207,131 for details of the composite web 38 described herein. Preferably, the marker 28 has a length of less than one inch and preferably about ⅝"; although, a single fiber as small as 0.5 in length with a diameter of approximately 16 microns can be used. With such a size, the composite web 38 can be used in a commercial labeler such as an 1110 labeler available from Monarch Marking Systems Inc., Dayton, Ohio. Although the marker 28 is shown with upper and lower sheets, 30, 32, it will be appreciated that the fibers 24 can be adhered to the lower sheet 32 only and the upper sheet can be eliminated.

The source of power 23 is enabled so as to cause the induction coils to heat the ferromagnetic alloy 20 above its melting point thereby creating a molten bath of ferromagnetic alloy. As will be noted, the reduced section 14 of the disk 12 extends into the metal 20. Although the metal is shown having a dome appearance thereon, this is slightly exaggerated for purposes of showing the reduced section 14 being received within the melt. In any case, a portion of the diameter of the disk 12 will extend below the upper most portions of the tundish to engage the ferromagnetic alloy 20 after it has reached its appropriate melting temperature. Depending upon the temperature of the alloy, the arm 19 will be lowered so as to place the reduced section 14 within the metal alloy and the motor 17 will be enabled thereby rotating the disk 12. The disk 12 will be rotated in the direction as shown by the arrow in FIG. 1 and a fiber of ferromagnetic metal 24 will be formed thereby. This fiber 24 can be as long as is required.

It will be appreciated that the rapid solidification process described will produce a fiber that is in ready-to-use condition, i.e., it goes from the molten state directly to the solid state in a state for immediate use. No subsequent treatment is required to achieve the properties sought.

Under optimum conditions, the fiber 24 could be of indefinite length, but it has been found that certain conditions affect the length of the fiber. The conditions that cause variation in the length of the fiber are rotational velocity of the disk 12, vibrations in the system and shape, design of the disk and viscosity of the melt.

Figure 6:
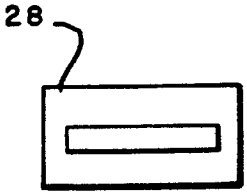
FIG. 6 is a plan of a composition web including a strip of ferromagnetic amorphous alloy disposed within a label.

The fiber 24 was cut into lengths of approximately $\frac{5}{8}$ of an inch and placed upon a first layer 32 of a label. A second layer 30 was placed over the fiber 24, in registration with the first layer, and with adhesive therebetween so as to form a label. The fibers 24 may be placed in aligned spaced relationship, as shown in FIG. 4, approximately one mm apart, or they can be located within the label in random fashion. It has been found that 3 or more fibers placed in alignment would be sufficient for the marker to be sensed readily in an interrogation zone; whereas, when the fibers were placed in random fashion, 5 or more fibers were sufficient. Placing the fibers 24 in random fashion, overlapping one another is unique in the field. Previous markers required multiple elements be aligned with and/or sequential from one another. Other orientations are possible. One or more fibers coiled, bent or curved can also provide acceptable responses for detection. It was found that the minimum total weight of fibers 24 that are detectable was approximately 0.2 milligrams. As shown in FIG. 6, a ribbon made of nickel rich, amorphous ferromagnetic alloy in the form of a ribbon can be used in a marker but the length of the ribbon 25 would be greater than the length of a fiber.

In the determination of the performance of a ferromagnetic marker, perhaps the most critical parameter is the $t_{\frac{1}{2}}$ which is the measure of how sharp the pulse induced by such marker is n an interrogation zone. More specifically, $t_{\frac{1}{2}}$ represents in microseconds the time lapse between rising and trailing portions at one half the peak value of the induced signal. A value of $t_{\frac{1}{2}}$ = 10 micro seconds or less is considered acceptable. A lower value is desirable because this indicates a sharp, easy to detect peak and hence high harmonic content. Certain unexpected properties were found in the ferromagnetic alloy of the instant invention. Normally when multiple fibers are placed in cross proximity of one another, there is a signal deterioration as determined by $t_{\frac{1}{2}}$. With the nickel rich alloys of the instant invention, such deterioration was not observed This results in the need of less material where multiple fibers are used. Another unexpected property was that the nickel rich alloys of the instant invention could be detected even when in virtual powder form. Fibers having its maximum dimension as small as 3.0 mm could be detected in a magnetic field of frequency 2 kHz. This result is contrary to anything that has been found or expected previously.

What is claimed is:

1. A marker for use in an electronic article surveillance system, the marker comprising: a ferromagnetic amorphous ferromagnetic element containing 35 to 55% nickel, up to 35% of at least one of iron and cobalt and a combination thereof and made by rapid solidification from a molten ferromagnetic alloy, and a carrier for said ferromagnetic amorphous element.

2. The marker of claim 1, wherein said element is a fiber.

3. The marker of claim 1, wherein said element is a ribbon.

4. A marker as defined in claim 1, wherein the carrier comprises a pressure sensitive label.

5. A marker as defined in claim 1, wherein the carrier comprises a tag.

6. A marker as defined in claim 1, wherein the carrier comprises fabric.

7. A marker as defined in claim 1, wherein the marker comprises paper into which the element is incorporated.

8. A marker for use in an electronic article surveillance system, the marker comprising: an amorphous ferromagnetic element made from a molten alloy containing 35 to 55% nickel, up to 35% of at least one of iron and cobalt, including a combination thereof and a carrier for said ferromagnetic amorphous element.

9. The marker of claim 8 wherein said element is in the form of a fiber.

10. The marker of claim 8 wherein said element is in the form of a ribbon.

11. A marker for use in an electronic article surveillance system, the marker comprising: a rapidly solidified ferromagnetic amorphous fiber having 35 to 55% nickel, up to 35% of at least one of iron and cobalt, including a combination thereof, a length less than 15 millimeters and a cross-sectional area of less than $6\times10^{-3}$ square millimeters.

12. A marker as defined in claim 11, wherein the marker element has a $t_{\frac{1}{2}}$ value of less than 10 microseconds at a driving frequency of 6kHz in a magnetic field of amplitude in the order of 10e.

13. A composite web of markers for use in an electronic article surveillance system, the composite web comprising: a web, a plurality of labels releasably supported by said web and a plurality of amorphous ferromagnetic elements having a composition containing 35 to 55% nickel and up to 35% of at least one of iron and cobalt and a combination thereof and supported by each of said labels.

14. The composite web of markers of claim 13 wherein each of said elements is in the form of a fiber.

15. The web of markers of claim 14 wherein said fibers are randomly oriented on each label.

16. The web of markers of claim 13 wherein each of said elements is in the form of a ribbon.

17. A method of making a marker for use in an electronic article surveillance system, comprising the steps of: rapidly solidifying an amorphous ferromagnetic element having a composition containing 35 to 55% nickel and up to 35% of at least one of iron and cobalt and a combination thereof from a pool of molten alloy, and incorporating the resulting element within a support.

18. The method of claim 17 including forming said element into a fiber.

19. The method of claim 17 including forming said element into a ribbon.

20. The method as defined in claim 17, wherein the incorporating step includes incorporating the element into fabric.

21. The method as defined in claim 9, wherein the incorporating step includes adding said fibers into a paper-making slurry, and converting the slurry into paper.

22. The method as defined in claim 18, further comprising the step of cutting the fiber into a plurality of fiber pieces, and wherein the incorporating step includes mounting the fiber pieces on a plurality of support members.

23. The method as defined in claim 22, wherein the cutting step includes cutting the fiber into a plurality of fiber pieces each having a predetermined length.

24. A method of making a composite web of markers for use in an electronic article surveillance system, comprising the steps of: providing a web of material, placing amorphous ferromagnetic marker elements having a composition containing 35 to 55% nickel and up to 35% of at least one of iron and cobalt and a combination thereof on the web, and wherein the material is divided into labels each having at least one marker element.

25. A marker for producing a detectable response in an electronic article surveillance system, the marker comprising: a support element, an amorphous ferromagnetic fiber having a composition containing 35 to 55% nickel and up to 35% of at least one of iron and cobalt and a combination thereof supported by the support element, the fiber having a cross sectional area of less than $66\times10^{-3}$ square millimeters.

26. A ferromagnetic marker for use in an article surveillance system comprising:

an amorphous ferromagnetic fiber having a composition containing 35 to 55% nickel and up to 35% of at least one of iron and cobalt and a combination thereof and an aspect ratio of greater than 50, said ferromagnetic amorphous fiber being positioned between two dielectric sheets, and said sheets being joined so as to hold said ferromagnetic amorphous fibers therebetween to form a marker.

27. The ferromagnetic marker of claim 26 wherein said marker has a length of less than one inch.

28. An amorphous, ferromagnetic fiber having a composition containing 35 to 55% nickel and up to 35% of at least one of iron and cobalt and a combination thereof, a nominal diameter no greater than 80 microns and a $t_{\frac{1}{2}}$ of less than 10 microseconds at a driving frequency of 6kHz and in a magnetic field of an amplitude in the order of one Oersted.

29. The fiber of claim 28 wherein said fiber has an aspect ratio greater than 50.

30. The fiber of claim 29 wherein said fiber has a kidney shaped cross section.

31. The fiber of claim 30 wherein said fiber has a generally circular cross section.

32. A ferromagnetic alloy, the composition comprising:

$$N_aC_bF_cS_dB_eM_f$$

where

N is nickel
C is cobalt
F is iron
S is silicon
B is at least one of boron and phosphorous
M is at least one of manganese, niobium, aluminum, chromium, vanadium and copper and
"a–f" are in atom percent
"a" ranges from 35 to 55
"b" is equal to or less than 35
"c" ranges from 0 to 35
"d" is equal to or less than 30
"e" is equal to or less than 30
"f" ranges from 0 to 10, said above ranges being given in atomic percent.

33. The alloy of claim 31 wherein said composition is in the form of a fiber.

34. The ferromagnetic amorphous alloy of claim 3 wherein said composition is in the form of a ribbon.

35. The composition of claim 32 wherein the amount of nickel is in the range of 45 to 50 atomic percent and the amounts of boron and silicon included therein are defined by the ratio $$0.55 < \frac{B}{S+B} < 0.65.$$

36. The composition of claim 34 wherein the amounts of cobalt, iron, silicon and boron are defined by the ratio $$1.25 < \frac{C+F}{S+B} < 1.80.$$

* * * * *